US005086820A

United States Patent [19]

Gelder

[11] Patent Number: 5,086,820

[45] Date of Patent: Feb. 11, 1992

[54] WOOD SPLITTING APPARATUS

[76] Inventor: Ian V. Gelder, P.O. Box 988, Minden, Nev. 89423

[21] Appl. No.: 589,427

[22] Filed: Sep. 28, 1990

[51] Int. Cl.[5] ..... B27L 7/00

[52] U.S. Cl. ..... 144/193 A; 144/366

[58] Field of Search ..... 144/3 K, 193 R, 193 A, 144/366

[56] References Cited

U.S. PATENT DOCUMENTS 3,356,115 12/1967 Cole ..... 144/193 R 3,995,672 12/1976 Binninger ..... 144/193 A

*Primary Examiner*—W. Donald Bray

*Attorney, Agent, or Firm*—Bielen, Peterson & Lampe

[57] ABSTRACT

An apparatus for dividing a wood piece such as a sawn log utilizing a support which lies adjacent a splitting head. The splitting head includes an open frame member which supports splitting knives. The wood piece is driven along the support through the splitting head in one direction to effect splitting of at least a portion of the wood piece. The unsplit portion of the wood piece is returned to the support in a reverse direction for division by the splitting head in a subsequent operation.

7 Claims, 3 Drawing Sheets

WOOD SPLITTING APPARATUS

BACKGROUND OF THE INVENTION

The present invention relates to a novel and useful wood splitting apparatus.

Wood splitting of sawn logs for use as firewood is normally accomplished manually with a mall or automatically with a mechanical wood splitter. For example, a typical wood splitter such as the Moose model wood splitter, manufactured by Bigfoot Industries Inc. of Minden, Nev., employs a splitting head having a multiplicity of cutting edges or knives and a pusher assembly which is normally hydraulic. Although effective in splitting wood logs, such prior devices often require the hand holding of the log during the splitting operation. In addition, determination of the size of the split pieces being produced requires a lengthy and tedious removal and replacement of the splitting head. In general, the prior art devices have a relatively low capacity which is not amenable to an automatic operation of processing of timber requiring the cutting of the logs into small pieces and splitting of the same.

A wood splitting apparatus which solves the problems found in the prior art would be a great advance in the firewood production industry.

SUMMARY OF THE INVENTION

In accordance with the present invention a novel and useful wood splitting apparatus is herein provided.

The wood splitting or dividing apparatus of the present invention utilizes a support for the wood piece which is sized for splitting. Normally, such wood piece takes the form of a "round" between 30 and 90 centimeters in length. These "rounds" may be employed to make bundle wood or cord wood. The support may include a channel or trough which is V-shaped to control in the orientation of the round throughout the cutting process. Such support may be placed on a stand which is supported on the ground surface.

The apparatus of the present invention also includes a splitting head having an open frame member forming an open chamber. A plurality of splitting knives or blades are supported from the frame, preferably within the chamber. In addition, the frame member includes a cutting edge which is capable of splitting the wood piece in conjunction with said splitting knives within the chamber formed by the frame member. Means may also be included for adjusting the height of the frame member cutting edge above the level of the support trough for the wood piece. In general, the frame member includes a top, a bottom, and a pair of sides between the top and bottom. The chamber further possesses a entrance and an exit thereto. The bottom of the chamber may slope away from the chamber entrance and downwardly from the top of the chamber to accommodate expansion of the wood piece during the cutting process. In addition, the sides of the chamber angle outwardly for the same purpose. The top and the bottom of the frame member forming the chamber may also be V-shaped of an angle similar to the V-shaped angle of the support for the wood piece. In this manner, the positioning of the wood is controlled to permit production of split wood pieces of a certain size and shape.

Means is also included in the present invention for driving the wood piece along the support and through the splitting head in one direction to effect splitting of at least a portion of the wood piece. Such means for driving the wood piece may take the form of a first plate which is urged by the motor means toward the splitting head by a motor, such as a hydraulic motor. Means for returning at least a portion of the wood piece which has not been split to the support is also found in the present invention. Such means for returning the wood piece may be externalize in another plate which is connected to the first plate by support channels, forming a push-pull carriage. The carriage is provided with a rail for sliding movement relative to the support. The rail may be removably connected to the push-pull carriage to facilitate maintenance of the same.

It may be apparent that a novel and useful apparatus for dividing a wood piece has been described.

It is therefore an object of the present invention to provide an apparatus for dividing a wood piece which eliminates manual stabilization of the wood piece being split.

Another object of the present invention is to provide an apparatus for dividing a wood piece which includes an adjustable splitting head for controlling the size of the split pieces of wood.

Yet another object of the present invention is to provide an apparatus for dividing a wood piece which is capable of producing bundle wood in an economical manner.

A further object of the present invention is to provide an apparatus for dividing a wood piece which has a very high capacity.

Yet another object of the present invention is to provide an apparatus for dividing a wood piece which readily compensates for expansion of the wood piece during the cutting process.

A further object of the present invention is to provide an apparatus for dividing a wood piece which is easily coupled to a log sawing machine.

Another object of the present invention is to provide an apparatus for dividing a wood piece which is relatively compact.

The invention possesses other objects and advantages especially as concerns particular characteristics and features thereof which will become apparent as the specification continues.

Figure 1:
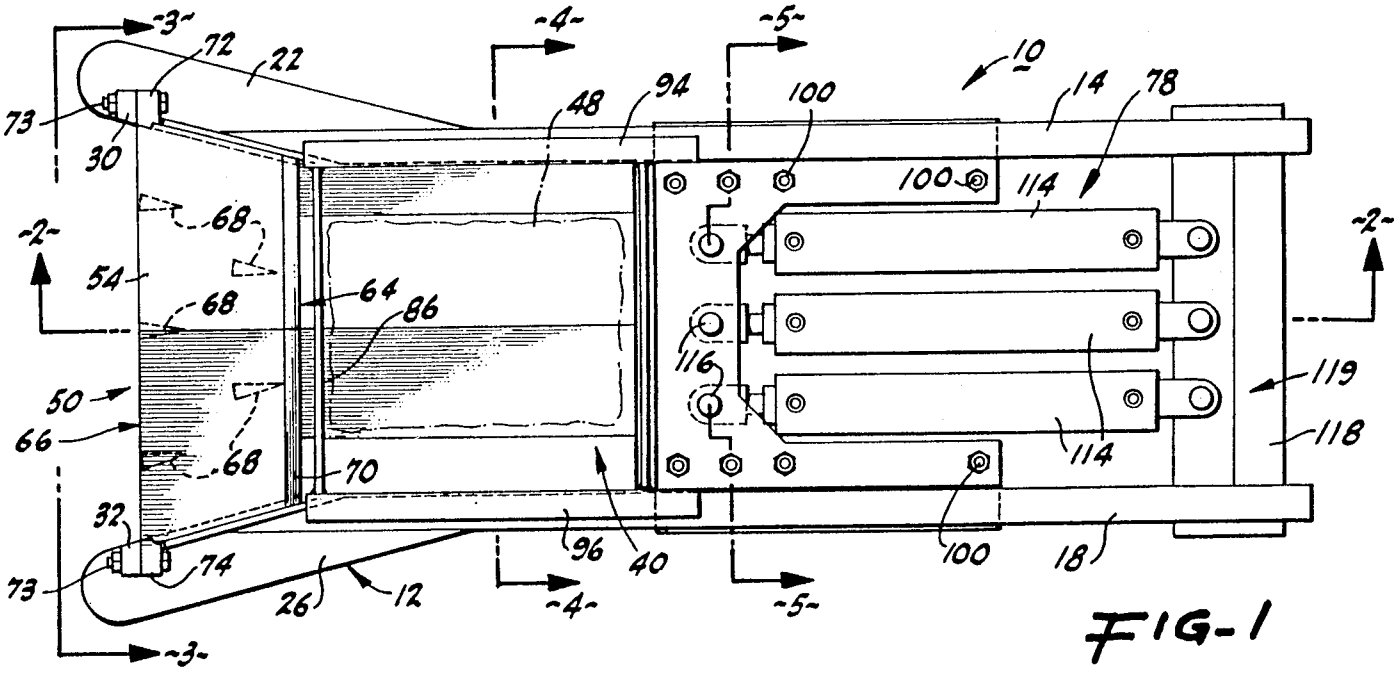
FIG. 1 is a top plan view of the apparatus of the present invention.

For a better understanding of the present invention reference is made to the following detailed description of the preferred embodiments thereof which should be referenced to the heretofore described drawings.

DESCRIPTION OF THE PREFERRED EMBODIMENTS

Various aspects of the present invention will evolve from the following description of the preferred embodiments which should be taken in conjunction with the drawings hereinabove described.

The invention as a whole is shown in the drawings by reference character 10. The wood dividing apparatus 10 includes as one of its elements a support 12. Support 12 is formed with a quartet of side channels 14, 16, 18, and 20, FIGS. 1 and 4. Channels 14, 16, 18, and 20 terminate in flared end portions 22, 24, 26, and 28, respectively. Blocks 30 and 32 are welded to channels 14, 16, 18, and 20 at one of the ends thereof. The Other ends of channels 16, 18, 20 and 22 are fastened to a cross member 34, FIG. 2. Base support 36 spands lower channels 16 and 20. Thus, slots 36 and 38 are formed between and along channels 14 and 16 and channels 18 and 20, respectively.

Figure 4:
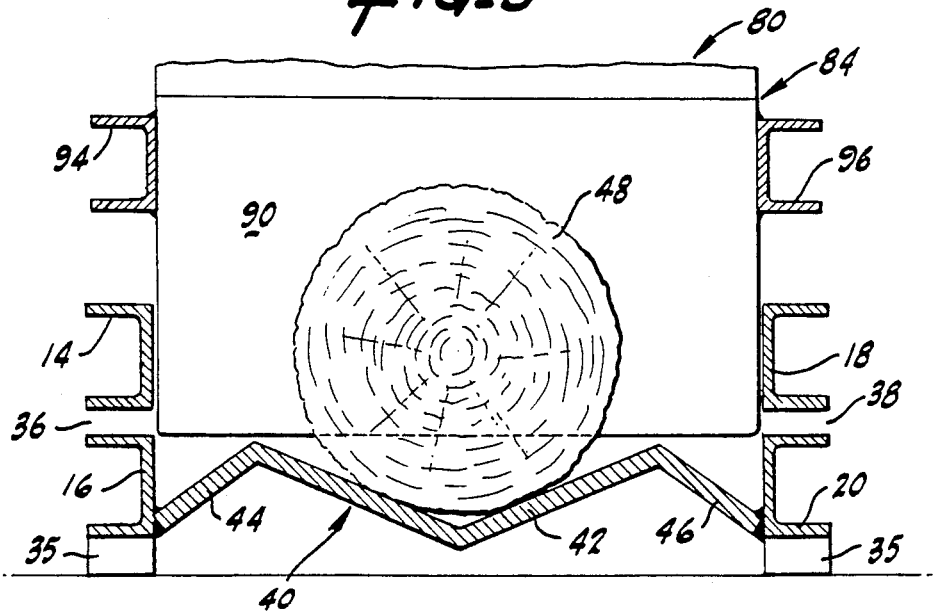
FIG. 4 is a sectional view taken along line 4—4 of FIG. 1.

Support 12 is also provided with a hopper 40 which is welded to channels 16 and 20, FIG. 4. Hopper 40 has a V-shaped section or trough 42 which is connected to support wings 44 and 46. Trough 42 is employed to slidingly support wood piece 48 during the wood splitting process, which will be described hereinafter.

Apparatus 10 is also constructed with splitting head 50 formed by a frame member 52 having a top portion 54, a bottom portion 56, and side portions 58 and 60. In the embodiment depicted in the drawings, top portion 54 and bottom portion 56 of splitting head 50 are V-shaped at a similar angle to trough 42 of hopper 40.

Frame member 52 includes an open chamber 62 having an entrance 64 and exit 66. A plurality knives or blades 68 lie within chamber 62 and are supported in various positions within chamber 62 by top portion 54 and bottom portion 56 of frame member 52. It should be noted that chamber 60 and the surrounding top and bottom portions 54 and 56 and side portions 58 and 60 expand between entrance 64 and exit 66. In particular, bottom portion 66 slopes downwardly away chamber entrance 64 and relative to top portion 54. In addition, sides 58 and 60 of frame member 52 angle outwardly relative to entrance 64 of chamber 62. Such structure accommodates the natural expansion of wood being split by apparatus 10. In addition, top portion 54 of frame member 52 includes a cutting edge 70, FIG. 2, which imparts a V-shaped cut to wood piece 48.

Figure 3:
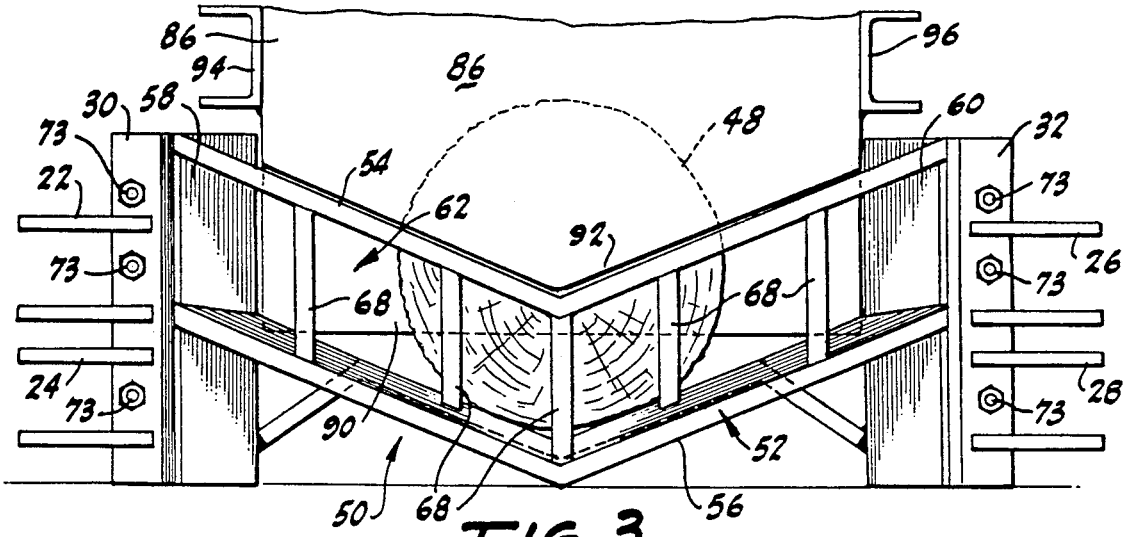
FIG. 3 is an end view taken along line 3—3 of FIG. 1.
Figure 6:
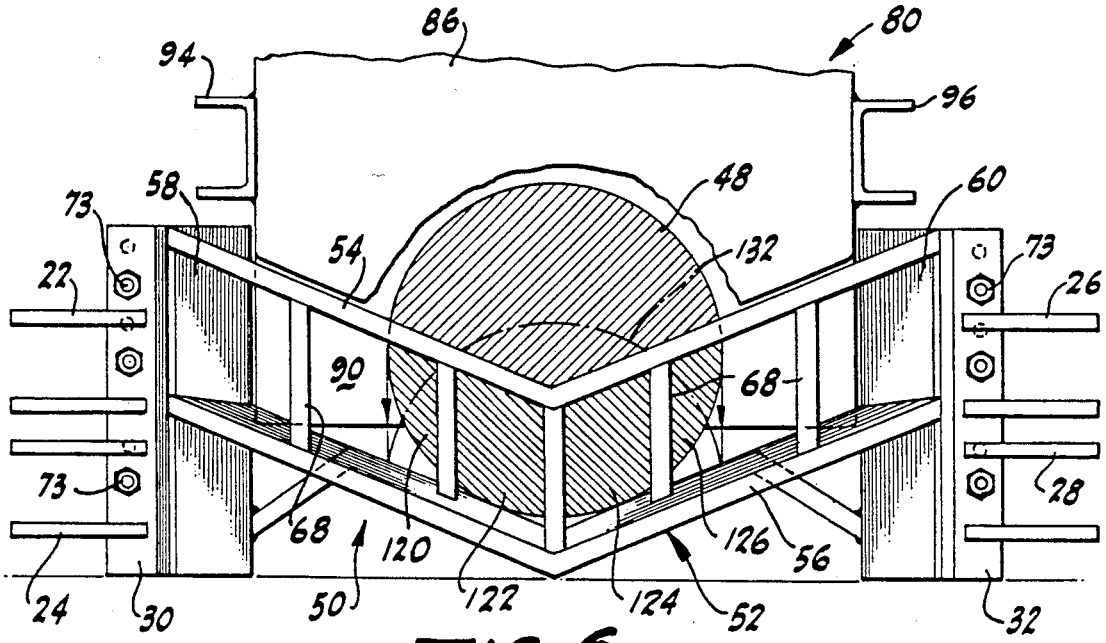
FIG. 6 is an end view depicting the cutting method performed with the apparatus of the present invention.
Figure 7:
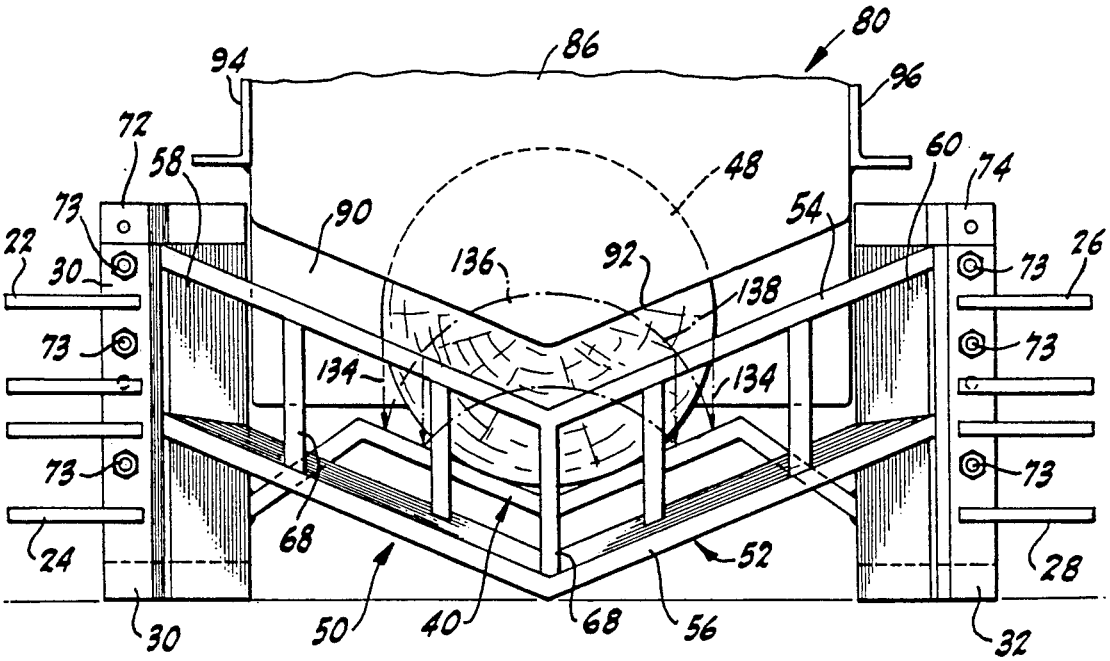
FIG. 7 is an end view of the apparatus of the present invention depicting the adjustability of the splitting head relative to the support for the wood piece in the present invention.

The sides 58 and 60 of splitting head 50 connect to blocks 72 and 74, respectively. Block 30 and block 72, as well as block 32 and block 74, are fastened by a plurality of nuts and bolts 73, FIGS. 1 and 3. With reference to FIGS. 6 and 7 it may observed that means 76 is also included for adjusting the height of cutting edge 70 relative to trough 42 of hopper 40. In this regard, blocks 70 and 72 move upwardly and downwardly relative to blocks 30 and 32 of support 12. Plurality of nuts and bolts 73 are unfastened and refastened to effect the repositioning of splitting head 50 relative to trough 42 of hopper 40. Thus, the cutting positions of plurality of knives 68 and cutting edge 70 on frame member 52 are adjustable, the purpose of which will be detailed hereinafter.

Figure 2:
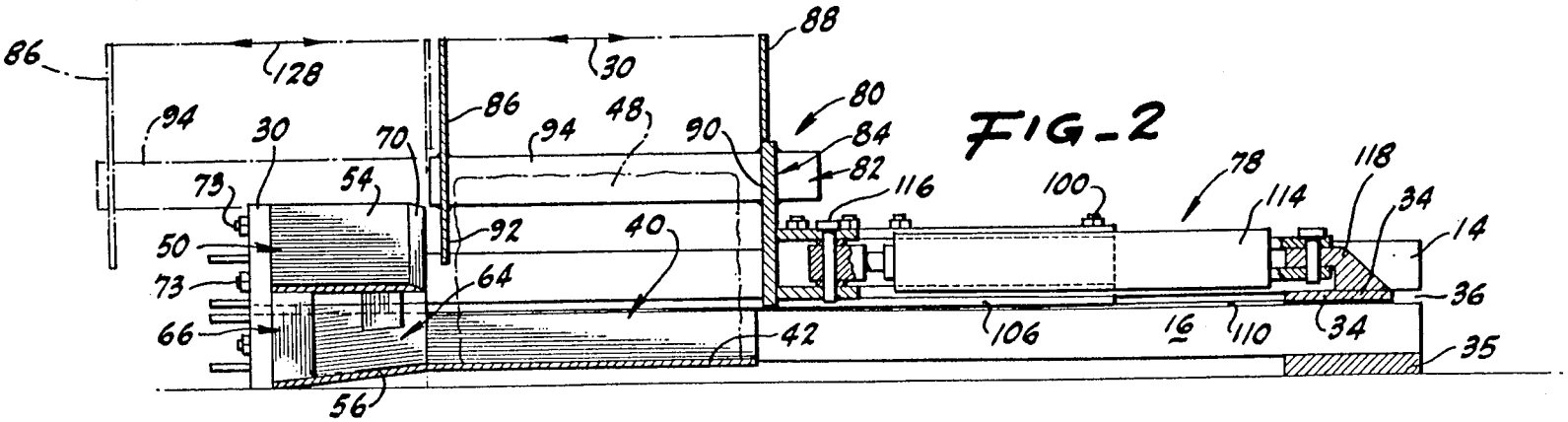
FIG. 2 is a sectional view taken along line 2—2 of FIG. 1.
Figure 5:
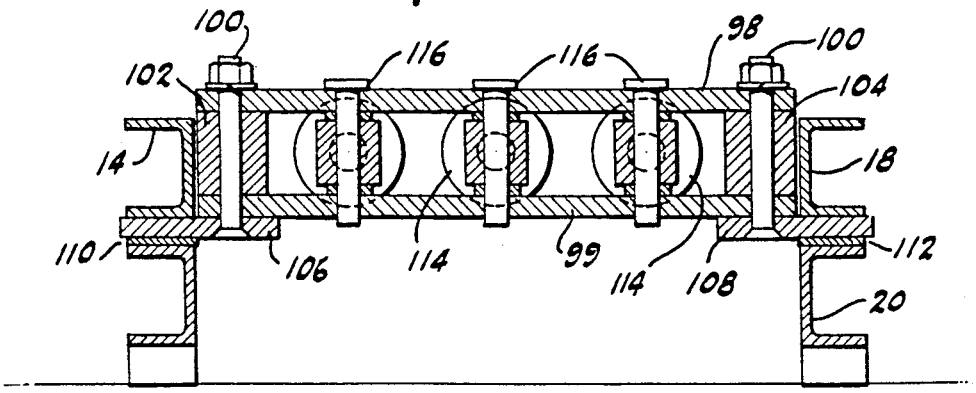
FIG. 5 is a sectional view taken along line 5—5 of FIG. 1.

Means 78, shown in FIGS. 1 and 2, is also included for driving wood piece 48 along trough 42 and through splitting head 50. Likewise, means 80 is also depicted for returning an unsplit portion of wood 48 to trough 42 subsequent to the initial splitting of wood piece 48. Means 78 and 80 are embodied in a push-pull carriage 82, FIGS. 1 and 2, having a first plate 84 and a second plate 86. First plate 84 includes an upper thin portion 88 and a lower thick portion 90 which is well suited for pushing wood piece 48 through splitting head 50. It should be noted that second plate 86 includes a lower V-shaped edge 92, FIG. 3, which conforms to the V-shaped top 54 of frame member 52. Channels 94 and 96 are welded to plates 84 and 86 to rigidly space the same from one another. A pair of plate 98 and 99 are welded to the thickened lower portion 90 of the first plate 84 and extend along channels 14, 16, 18, and 20. The plurality of bolts 100 compress plates 98 and 99 between spacer bars 102 and 104. In addition, plurality fasteners 100 hold rails 106 and 108, FIG. 5, which ride on strips 110 and 112 found within slots 36 and 38. Strips 110 and 112 may be of smooth material, metallic or otherwise, to aid in the travel of rails 106 and 108 along slots 36 and 38.

Plates 98 and 99 also serves as a support for a plurality of hydraulic cylinders 114 whose piston ends are held thereto by plurality of pins 116. The opposite ends of hydraulic cylinder 114 are bolted to support member 118 by plurality of fasteners 119. Support member is welded to cross member 34. It should be realized that the controlling mechanism for the activation of hydraulic cylinders 114 is not shown, but may be a conventional design.

In operation, the user places wood piece 48 within trough 42 of hopper 40 found on support 12. Hydraulic cylinders are activated to extend the pistons ends thereof which in turns moves push-pull carriage 82 toward splitting head 50. Plate 84 contacts wood piece 48 causing the same to contact plurality of knives 68 and cutting edge 70 of top portion 54 of frame member 52. With reference to FIG. 6 it may be observed that wood sections 120, 122, 124, and 126 are produced during the travel of plate 84 towards splitting head 50. It should be observed that V-shaped bottom portion 92 of plate 84 guides over the V-shaped top 54 of frame member 52, shown in phantom on FIG. 2 and illustrated by directional arrows 128. Plurality of hydraulic cylinders 114 are then reversed causing retraction of the piston portions which moves push-pull carriage 82 into the position shown solid line on FIG. 2, directional arrows 130. Such return of the push-pull carriage 82 returns the upper portion of piece 48 having a lower V-shaped cut, depicted by broken line 132 on FIG. 6 through trough 42 of hopper 40. Means 78 may be again activated to resplit with the returned V-shaped upper portion of the piece 48. With reference to FIG. 7 it may be observed that splitting head 50 may be adjusted downwardly to produce smaller portions from piece 48, directional arrows 134. The activation of driving means 78 and returning means 80 would produce smaller portions split from wood piece 48, depicted by broken lines 136 and 138 of FIG. 7. The latter position of splitting head 50 is conducive to the efficient production of bundle wood. Thus, the back and forth action of apparatus 10 capable of splitting wood piece 48 without hand holding of the same into predetermined sizes according to the position of splitting head 50 relative to trough 42.

While in the foregoing embodiments of the invention have been set forth in considerable detail for the purposes of making a complete disclosure of the invention it may be apparent to those of skill in the art that numerous changes may be made in such details without departing from the spirit and principles of the invention.

What is claimed is:

1. An apparatus for dividing a wood piece utilizing a motor, the improvement comprising:

a. a support for a wood piece said support possessing a substantially V-shape surface;

b. a splitting head, said splitting head including a frame member and a plurality of splitting knives supported therefrom, said head lying adjacent said support, said frame member providing an open chamber and said plurality of splitting knives being supported within said chamber, said splitting head chamber having a top, bottom, and a pair of sides therebetween, and further includes an entrance and an exit thereto, said top of said splitting bead being substantially V-shaped;

c. means for driving he wood piece along said support and through said splitting head in one direction utilizing the motor to effect splitting of at least one portion of the wood piece, said means for driving the wood piece along said support and through said splitting head including a first plate and said means for returning the wood piece including a spaced second plate, said second plate having a V-shaped edge portion conforming to said V-shaped top of splitting head; and d. means for returning at least another unsplit portion of the wood piece to said support in conjunction with the motor and subsequent to said splitting of said one portion of the wood piece.

2. The apparatus of claim 1 in which said bottom of said chamber slopes away from said chamber entrance and downwardly relative to said top of said chamber.

3. The apparatus of claim 2 in which at least one of said sides of said chamber angles outwardly relative to said entrance to said chamber.

4. The apparatus of claim 1 which additionally includes a cutting edge along said top of said splitting head frame member.

5. The apparatus of claim 4 which additionally comprises means for adjusting the height of said cutting edge above the level of said support.

6. The apparatus of claim 1 in which said first and second plates connect to rail means for sliding movement relative to said support.

7. The apparatus of claim 6 in which said rail means is removably connected to said first and second plates.

* * * * *

UNITED STATES PATENT AND TRADEMARK OFFICE

CERTIFICATE OF CORRECTION

PATENT NO. : 5,086,820

DATED : February 11, 1992

INVENTOR(S) : Van Gelder, Ian

It is certified that error appears in the above-identified patent and that said Letters Patent is hereby corrected as shown below:

On the title page, item [76] Inventor: should read as follows:

--[76] Inventor: Ian Van Gelder--.

Signed and Sealed this

Fourth Day of May, 1993

*Attest:*

Michael K. Kirk

MICHAEL K. KIRK

*Attesting Officer*

*Acting Commissioner of Patents and Trademarks*